US011407011B2

(12) United States Patent
Shoptaugh

(10) Patent No.: US 11,407,011 B2
(45) Date of Patent: Aug. 9, 2022

(54) PAINT ROLLER DEBRIS DEPOSIT PAD

(71) Applicant: Randy Shoptaugh, Evansville, IN (US)

(72) Inventor: Randy Shoptaugh, Evansville, IN (US)

( * ) Notice: Subject to any disclaimer, the term of this patent is extended or adjusted under 35 U.S.C. 154(b) by 373 days.

(21) Appl. No.: 16/728,167

(22) Filed: Dec. 27, 2019

(65) Prior Publication Data

US 2021/0197234 A1 Jul. 1, 2021

(51) Int. Cl.

| | |
|---|---|
| ***B05C 17/00*** | (2006.01) |
| ***B05C 17/02*** | (2006.01) |
| ***B08B 1/00*** | (2006.01) |

(52) U.S. Cl.

CPC ..... *B08B 1/001* (2013.01); *B05C 17/0222* (2013.01); *B05C 17/0245* (2013.01)

(58) Field of Classification Search

CPC ..... B05C 17/022; A47L 13/23; A47L 1/08

See application file for complete search history.

(56) References Cited

U.S. PATENT DOCUMENTS

| | | | | |
|---|---|---|---|---|
| 4,012,151 | A * | 3/1977 | Spransy | B05C 17/0235 401/23 |
| 4,387,477 | A | 6/1983 | Eisenberg | |
| 4,987,632 | A | 1/1991 | Rowe | |
| 5,983,437 | A | 11/1999 | Wakat | |
| 6,405,403 | B1 | 6/2002 | McKay | |
| 6,688,367 | B1 * | 2/2004 | Ruposky | E04F 21/16 15/236.01 |
| 8,510,894 | B2 | 8/2013 | Mrouse | |
| 8,821,058 | B2 * | 9/2014 | Walker | B05C 17/003 401/203 |
| 2010/0089931 | A1 | 4/2010 | Sheeby | |

* cited by examiner

*Primary Examiner* — Michael D Jennings

(57) ABSTRACT

A paint roller debris deposit pad for holding excess paint and debris from a painted surface includes a mount which is removably coupled to a paint roller frame. The mount includes a pair of retention tabs. Each of the retention tabs is attached to and extends frontwardly from a respective one of a top edge and a bottom edge of the mount. A plurality of couplers is attached to and extends rearwardly from the rear surface wherein each of the plurality of couplers removably couple the mount to the paint roller frame. A pad is removably coupled to the mount using the retention tabs. The pad receives and holds any excessive paint and debris found and removed from a surface after being painted by a paint roller.

8 Claims, 5 Drawing Sheets

PAINT ROLLER DEBRIS DEPOSIT PAD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to paint cleanup devices and more particularly pertains to a new paint cleanup device for holding excess paint and debris from a painted surface. The invention is for receiving any paint or debris removed from a freshly painted wall. By being attached to the paint roller frame the invention removes the need to find a cleaning cloth or other cleaning tool.

(2) Description of Related Art Including Information Disclosed Under 37 CFR 1.97 and 1.98

The prior art relates to paint cleanup devices. The disclosed inventions pertain to removing paint from a roller or the surface directly. The prior disclosed inventions are silent as to being a depository for removed paint and debris from the freshly painted surface.

BRIEF SUMMARY OF THE INVENTION

An embodiment of the disclosure meets the needs presented above by generally comprising a mount which is removably coupled to a paint roller frame. The mount has a front surface, a rear surface and a perimeter surface extending between the front surface and the rear surface. The perimeter surface has a top edge, a bottom edge, a first lateral edge, and a second lateral edge. The mount includes a pair of retention tabs. Each of the retention tabs is attached to and extends frontwardly from a respective one of the top edge and the bottom edge. A plurality of couplers is attached to and extends rearwardly from the rear surface wherein each of the plurality of couplers is configured to removably couple the mount to the paint roller frame. A pad has a first side, a second side, a top surface, a bottom surface, a first lateral surface and a second lateral surface. The pad is configured to removably couple to the front surface of the mount using the retention tabs. The pad receives and holds any excessive paint and debris found and removed from a surface after being painted by a paint roller.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
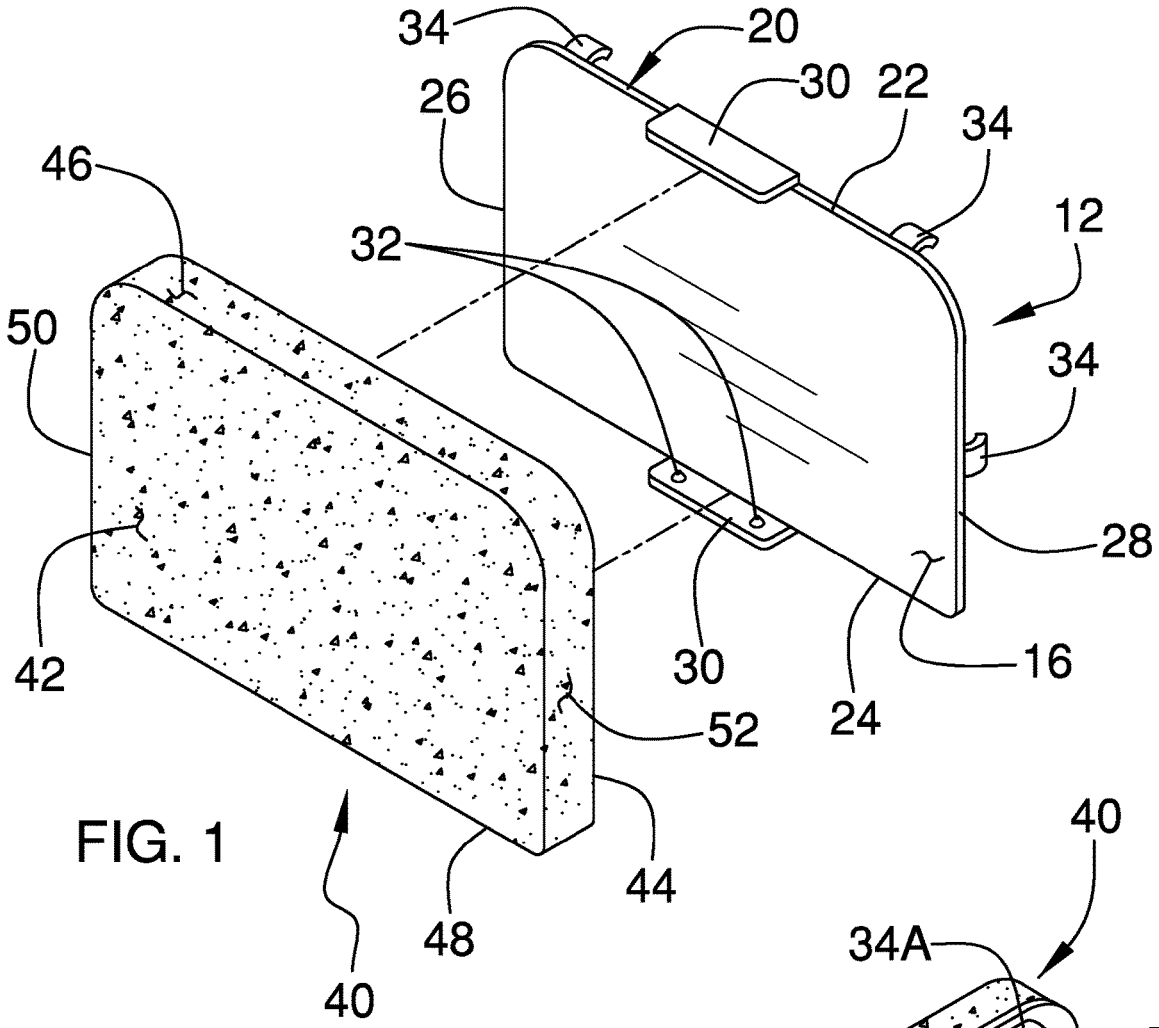
FIG. 1 is an exploded isometric view of a paint roller debris deposit pad according to an embodiment of the disclosure.
Figure 2:
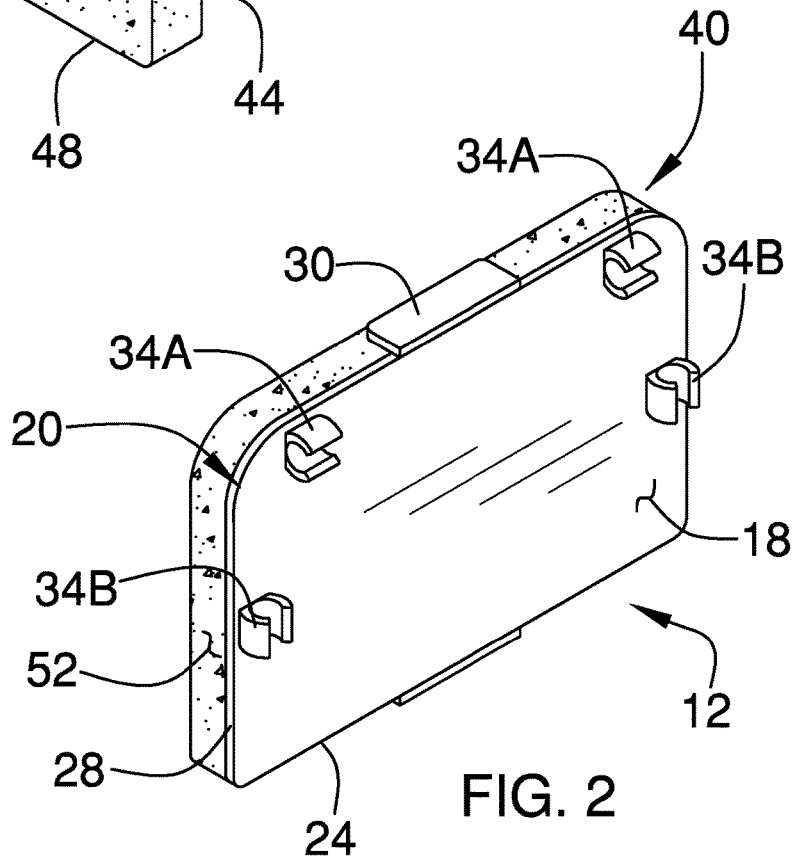
FIG. 2 is a rear isometric view of an embodiment of the disclosure.
Figure 3:
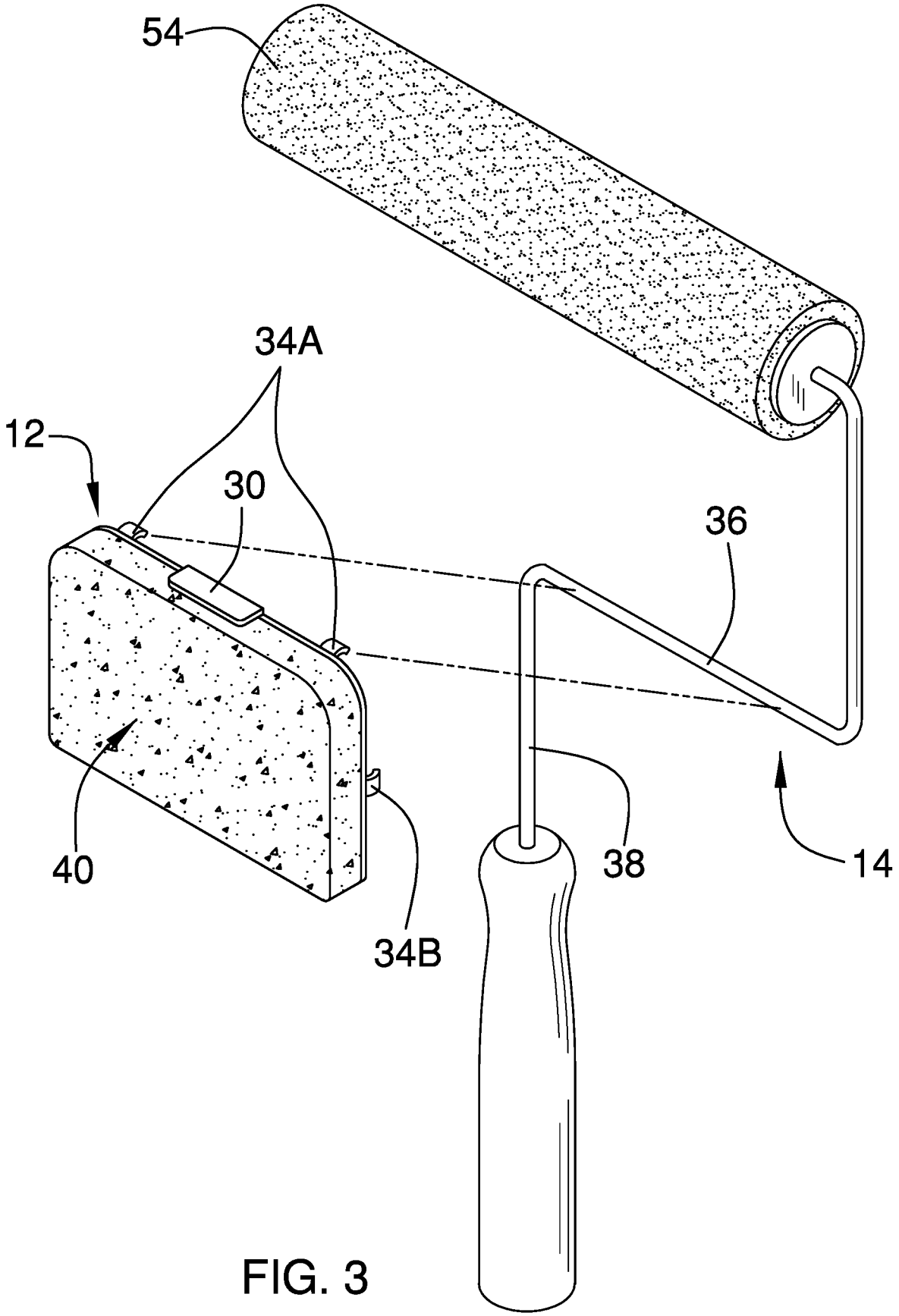
FIG. 3 is a front isometric view of an embodiment of the disclosure illustrating attachment to a paint roller frame.
Figure 4:
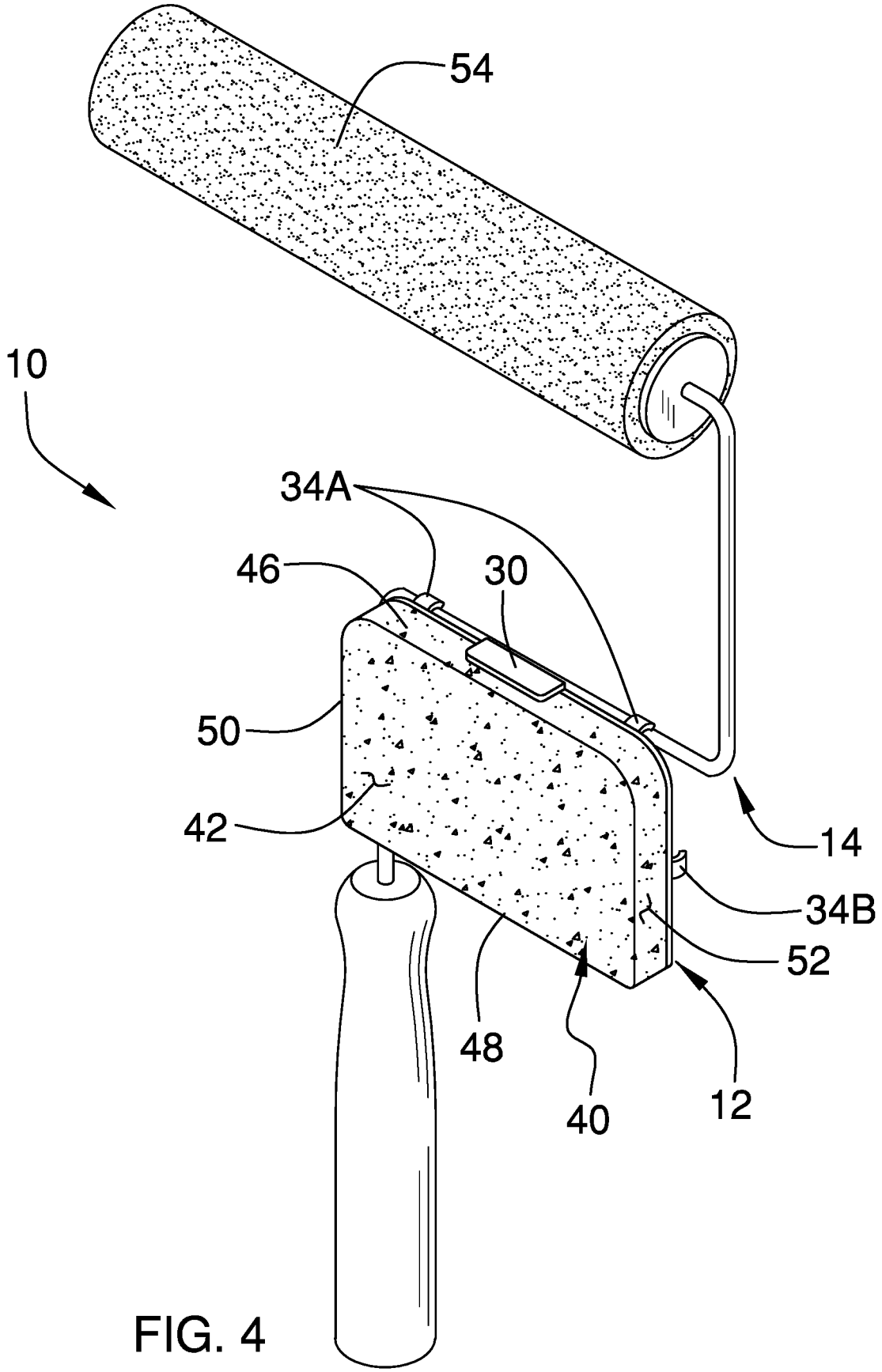
FIG. 4 is a front isometric view of an embodiment of the disclosure.
Figure 5:
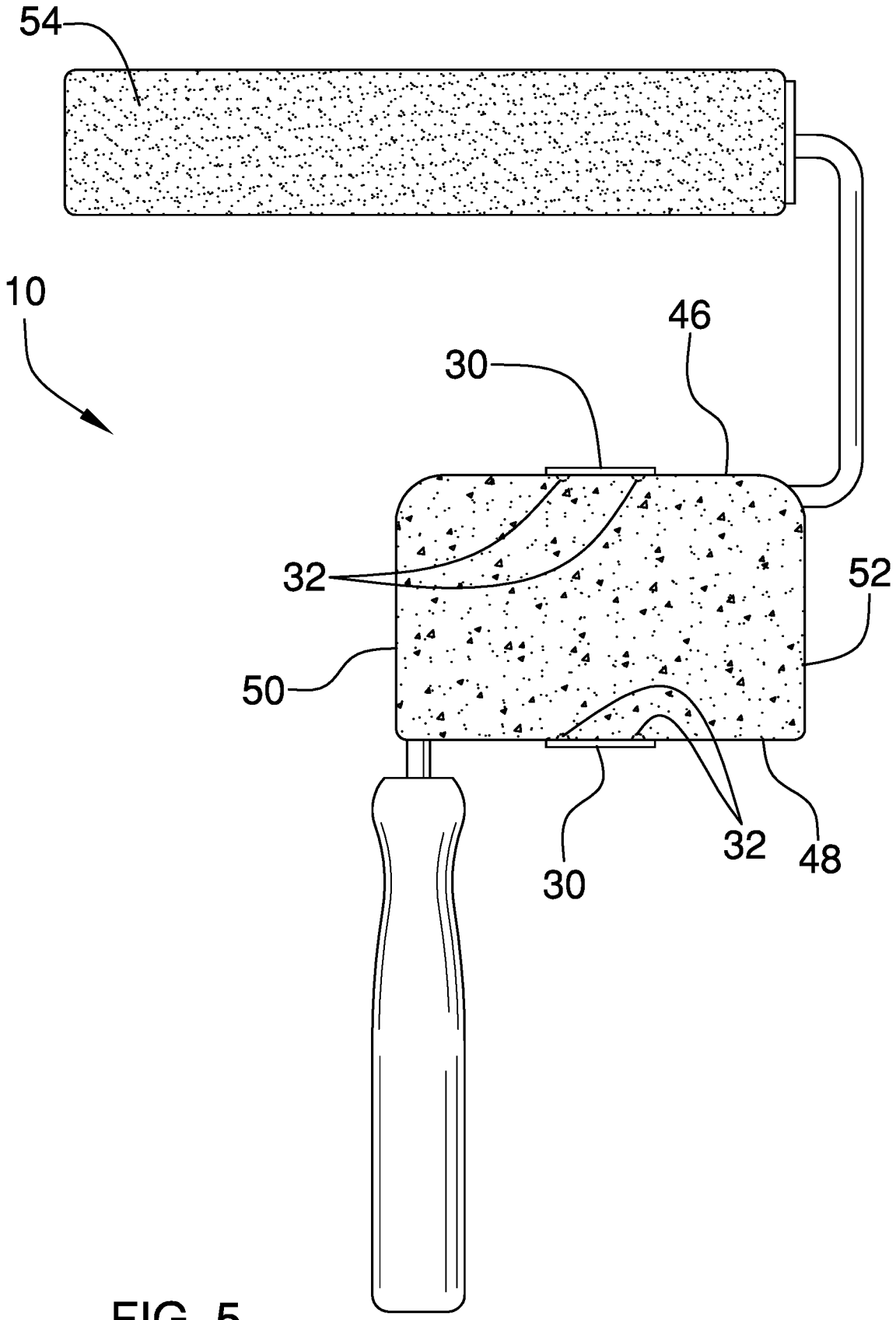
FIG. 5 is a front side view of an embodiment of the disclosure.
Figure 6:
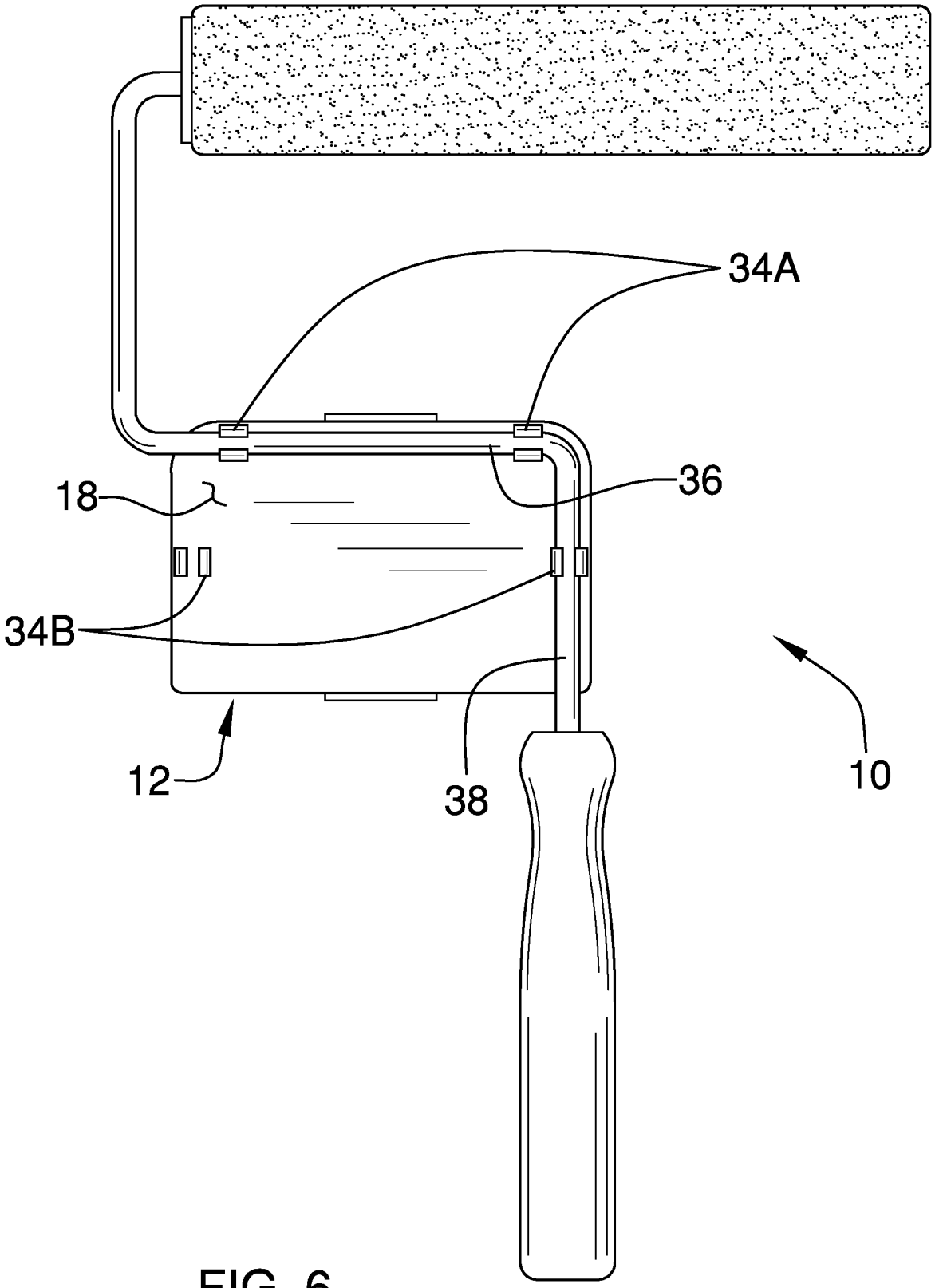
FIG. 6 is a rear side view of an embodiment of the disclosure.

With reference now to the drawings, and in particular to FIGS. 1 through 6 thereof, a new paint cleanup device embodying the principles and concepts of an embodiment of the disclosure and generally designated by the reference numeral 10 will be described.

As best illustrated in FIGS. 1 through 6, the paint roller debris deposit pad 10 generally comprises a mount 12 is removably coupled to a paint roller frame 14. The mount 12 has a front surface 16, a rear surface 18 and a perimeter surface 20 extending between the front surface 16 and the rear surface 18. The perimeter surface 20 has a top edge 22, a bottom edge 24, a first lateral edge 26, and a second lateral edge 28. The mount 12 may be made of any sufficiently rigid material including metal, rigid plastics, wood, or other conventionally available materials.

The mount 12 includes a pair of retention tabs 30. Each of the retention tabs 30 is attached to and extends frontwardly from a respective one of the top edge 22 and the bottom edge 24. The pair of retention tabs 30 is positioned centrally between the first lateral edge 26 and the second lateral edge 28. Each of the retention tabs 30 has a pair of detents 32. The pair of detents 32 is attached to and extends inwardly from the retention tab 30 toward an oppositely positioned one of the pair of retention tabs 30.

A plurality of couplers 34 is attached to and extends rearwardly from the rear surface 18 wherein each of the plurality of couplers 34 is configured to removably couple the mount 12 to the paint roller frame 14. The plurality of couplers 34 includes a top pair of couplers 34A. The top pair of couplers 34A is positioned axially aligned adjacent to the top edge 22. The plurality of couplers 34 includes a lateral pair of couplers 34B.

Each of the lateral pair of couplers 34B is positioned adjacent to a respective one of the first lateral edge 26 and the second lateral edge 28. The top pair of couplers 34A removably attach to a horizontal portion 36 of the paint roller frame 14. Each of the lateral pair of couplers 34B is positioned to secure the mount 12 to either side of a vertical portion 38 of the paint roller frame 14 to accommodate a user being left-handed or right-handed. The plurality of couplers 34 may be made of an elastomeric material to repeatably removably couple the mount 12 to the paint roller frame 14.

A pad 40 has a first side 42, a second side 44, a top surface 46, a bottom surface 48, a first lateral surface 50 and a second lateral surface 52. The pad 40 is configured to removably couple to the front surface 16 of the mount 12 using the retention tabs 30. The second side 44 is positioned to abut the front surface 16 of the mount 12. The first side 42 is configured to receive and hold any debris or excessive paint removed from a surface after a paint roller 54 attached to the paint roller frame 14 has painted the surface. The user may clean the user's finger or a tool by wiping the finger or tool onto the first side 42 after wiping the finger or tool along the surface to remove the excessive paint or the debris. The top surface 46 is positioned adjacent to the top edge 22 of the mount 12 when the pad 40 is coupled to the mount 12. The first lateral surface 50 is positioned adjacent to the first lateral edge 26 when the pad 40 is coupled to the mount 12. The pad 40 may be dampened with water to aid in depositing and cleaning the paint or debris from the finger or the tool. The pad 40 is configured to withstand cleaning with water to remove deposited paint and debris from the pad 40.

In use, the mount 12 is removably coupled to the paint roller frame 14. The pad 40 is removably coupled to the mount 12. The user deposits any excess paint, from a drip or a run left on the newly painted surface, onto the pad 40. The user deposits any debris found on the surface onto the pad 40. The pad 40 is removed and cleaned when covered with paint or debris. The cleaned pad 40 is removably attached to the mount 12 for further use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint roller debris deposit pad assembly configured to receive excess paint or debris from a wall during painting with a paint roller, said paint roller debris deposit pad assembly comprising:

a mount being removably coupled to a paint roller frame, said mount having a front surface, a rear surface and a perimeter surface extending between said front surface and said rear surface, said perimeter surface having a top edge, a bottom edge, a first lateral edge, and a second lateral edge, said mount comprising:

a pair of retention tabs, each of said retention tabs being attached to and extending frontwardly from a respective one of said top edge and said bottom edge;

a plurality of couplers being attached to and extending rearwardly from said rear surface wherein each of said plurality of couplers is configured to removably couple said mount to said paint roller frame; and a pad having a first side, a second side, a top surface, a bottom surface, a first lateral surface and a second lateral surface, said pad being configured to removably couple to said front surface of said mount using said retention tabs.

2. The paint roller debris deposit pad assembly according to claim 1, wherein said pair of retention tabs are positioned centrally between said first lateral edge and said second lateral edge.

3. The paint roller debris deposit pad assembly according to claim 1, wherein each of said retention tabs have a pair of detents, said pair of detents being attached to and extending inwardly from said retention tab toward the oppositely positioned retention tab.

4. The paint roller debris deposit pad assembly according to claim 2, wherein each of said retention tabs have a pair of detents, said pair of detents being attached to and extending inwardly from said retention tab toward the oppositely positioned retention tab.

5. The paint roller debris deposit pad assembly according to claim 1, wherein said plurality of couplers includes a top pair of couplers being positioned axially aligned adjacent to said top edge.

6. The paint roller debris deposit pad assembly according to claim 5, wherein said plurality of couplers includes a lateral pair of couplers, each coupler of said lateral pair of couplers being positioned adjacent to a respective one of said first lateral edge and said second lateral edge.

7. The paint roller debris deposit pad assembly according to claim 1, wherein said second side is positioned to abut said front surface of said mount, said first side being configured to receive and hold any debris or excessive paint removed from a surface after the paint roller has painted said surface, said top surface being positioned adjacent to said top edge of said mount when said pad is coupled to said mount, said first lateral surface being positioned adjacent to said first lateral edge when said pad is coupled to said mount.

8. A paint roller debris deposit pad assembly configured to receive excess paint or debris from a wall during painting with a paint roller, said paint roller debris deposit pad assembly comprising:

a mount being removably coupled to a paint roller frame, said mount having a front surface, a rear surface and a perimeter surface extending between said front surface and said rear surface, said perimeter surface having a top edge, a bottom edge, a first lateral edge, and a second lateral edge, said mount comprising:

a pair of retention tabs, each of said retention tabs being attached to and extending frontwardly from a respective one of said top edge and said bottom edge, said pair of retention tabs being positioned centrally between said first lateral edge and said second lateral edge;

each of said retention tabs having a pair of detents, said pair of detents being attached to and extending inwardly from said retention tab toward the oppositely positioned retention tab;

a plurality of couplers being attached to and extending rearwardly from said rear surface wherein each of said plurality of couplers is configured to removably couple said mount to said paint roller frame, said plurality of couplers including a top pair of couplers being positioned axially aligned adjacent to said top edge, said plurality of couplers including a lateral pair of couplers, each coupler of said lateral pair of couplers being positioned adjacent to a respective one of said first lateral edge and said second lateral edge; and a pad having a first side, a second side, a top surface, a bottom surface, a first lateral surface and a second lateral surface, said pad being configured to removably couple to said front surface of said mount using said retention tabs, said second side being positioned to abut said front surface of said mount, said first side being configured to receive and hold any debris or excessive paint removed from a surface after the paint roller has painted said surface, said top surface being positioned adjacent to said top edge of said mount when said pad is coupled to said mount, said first lateral surface being positioned adjacent to said first lateral edge when said pad is coupled to said mount.

* * * * *